US005396396A

United States Patent [19]

Watanabe

[11] Patent Number: 5,396,396

[45] Date of Patent: Mar. 7, 1995

[54] ELECTRONIC APPARATUS AND METHOD FOR GROUNDING ELECTRONIC APPARATUS

[75] Inventor: Haruo Watanabe, Tachikawa, Japan

[73] Assignee: Kabushiki Kaisha Toshiba, Kawasaki, Japan

[21] Appl. No.: 760,328

[22] Filed: Sep. 16, 1991

[30] Foreign Application Priority Data

Sep. 20, 1990 [JP] Japan ..... 2-98598 U

[51] Int. Cl.[6] ..... H01H 3/16; H05F 3/02

[52] U.S. Cl. ..... 361/212; 361/214; 361/220; 200/61.62; 200/61.81; 200/50 A

[58] Field of Search ..... 361/212, 214, 220; 200/61.62, 61.7, 61.82, 61.83, 50 A; 206/328

[56] References Cited

U.S. PATENT DOCUMENTS 4,163,939 8/1979 Halstead et al. ..... 324/104
4,760,492 7/1988 Walsh ..... 361/214

OTHER PUBLICATIONS

Pavey, N. K.; IBM Technical Disclosure Bulletin; vol. 21, No. 4, Sep. 1978; "Mechanical/Electrical Cover Latch".

*Primary Examiner*—A. D. Pellinen
*Assistant Examiner*—Fritz M. Fleming
*Attorney, Agent, or Firm*—Finnegan, Henderson, Farabow, Garrett & Dunner

[57] ABSTRACT

An electronic apparatus which is placed in an operation wait state by fully closing a cover having an electrical component, and a method for grounding the electronic apparatus is disclosed. The apparatus includes a cover side contact element electrically connected to the electrical component, and a body side contact element electrically connected to a grounding member of the apparatus. Both contact elements are brought into contact with each other so as to electrically connect the electrical component with the grounding member of the apparatus when the cover is fully closed. Thus, grounding of the electrical component can be insured without using a conductive wire for connecting the electrical component with the grounding member of the apparatus. Furthermore, a misfunction of the electrical component caused by an electrostatic charge is prevented while reducing a troublesome assembly work of the apparatus and the number of components. In addition, since the apparatus includes a switch comprising a displacement element provided on at least one of the two contact elements, the opened and closed positions of the cover can be detected in response to a displacement of the displacement element. Thus, an exclusive switching unit such as a microswitch and an operational member for actuating an actuator of the switching unit are not required. The apparatus can therefore detect a full closed position of the cover without increasing the number of components and the overall size of the apparatus. Furthermore, a misoperation by an operator and a misfunction of the apparatus can be prevented.

8 Claims, 9 Drawing Sheets

ELECTRONIC APPARATUS AND METHOD FOR GROUNDING ELECTRONIC APPARATUS

BACKGROUND OF THE INVENTION

1. Field of the Invention

The present invention relates to electronic apparatus such as facsimile apparatus, copying machines, or the like and a method for grounding the electronic apparatus. More particularly, the present invention relates to an electronic apparatus having an electrical component disposed on a cover pivotally supported on the apparatus, in which the apparatus is placed in a standby state (operation wait state) when the cover is fully closed, and also relates to a method of grounding the electronic apparatus.

2. Description of the Related Art

FIG. 18 illustrates a conventional type of facsimile apparatus as an example of the above electronic apparatus.

The facsimile apparatus A comprises a body B and a cover C pivotally mounted on the apparatus body B so as to be opened and closed. The apparatus body B has a platen roller D mounted therein. The cover C has a printer unit E mounted thereon as an electrical component.

In operation, an operator opens the cover C to a position as shown in phantom lines, mounts printing paper in the apparatus body B via a paper holder (not shown), extends the front end of the printing paper and place it on the platen roller D, and rotates the cover C to a full closed position shown in solid lines. This causes the facsimile apparatus A to be in a standby state, i.e., the state where the transmission and reception are possible when a main power switch is turned on. In order to prevent an electrostatic charge due to a friction of the printer unit E and the printing paper which causes the printer unit E to misfunction or be damaged, the facsimile apparatus A is designed such that the cover C supporting the printer unit E is connected through a grounding wire G to a grounding member F attached to the body B is insure the grounding of the printer unit E. However, connecting a grounding wire between two separate and relatively movable components is troublesome and therefore deteriorates productivity of the facsimile apparatus.

The facsimile apparatus A is also provided with a switch (not shown) which detects the full closed position of the cover C in order to prevent a misoperation of an operator and a misfunction of the apparatus A. An ON signal of the switch causes an indicator lamp (not shown) to light so that the operator can confirm the full closed position of the cover C, and a control unit (not shown) receives the ON signal as an interlocking signal for enabling transmission and reception operation of the facsimile apparatus A so that the facsimile apparatus A is operated only when the cover C is fully closed.

This arrangement of the facsimile apparatus A requires an exclusive switch means such as a microswitch and a mechanism for activating an actuator of the switch means, which results in the increase number of components. As the number of components increases, installation spaces for the switch means and the operation mechanism are also required, so that the overall size of the facsimile apparatus A increases.

Thus, the prior-art electronic apparatus requires a troublesome assembly work in order to insure the grounding of electrical components and entails increases in the number of components and the overall size of the apparatus.

SUMMARY OF THE INVENTION

The present invention has been made in view of the drawbacks in the prior art. An object of the present invention is to provide an electronic apparatus capable of ensuring a grounding of electrical components without a troublesome assembly work to thereby prevent a misfunction of the electrical components caused by an electrostatic charge and which is also capable of detecting the full closed position of a cover without need for increasing the number of components and the overall size of the electronic apparatus to prevent a misoperation of an operator and the misfunction of the electronic apparatus.

DESCRIPTION OF THE PREFERRED EMBODIMENTS

The preferred embodiments of the present invention will be described in detail with reference to the attached drawings hereinafter.

Figure 1:
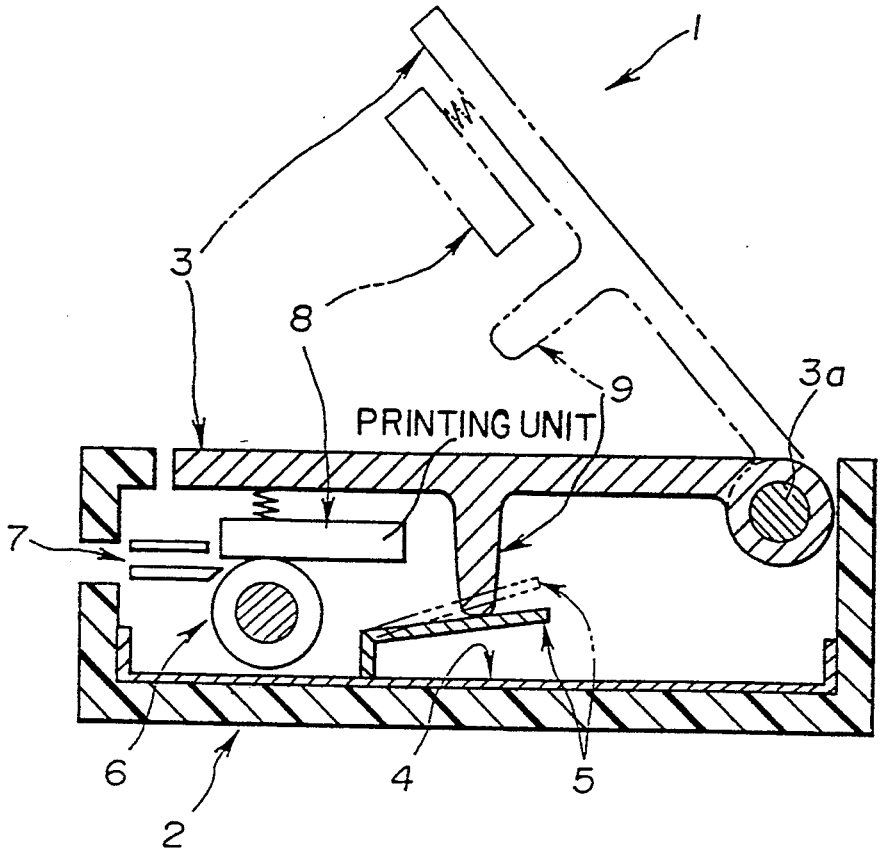
FIG. 1 is a schematic diagram of a longitudinal section of an electronic apparatus of a first embodiment of the present invention.
Figure 2:
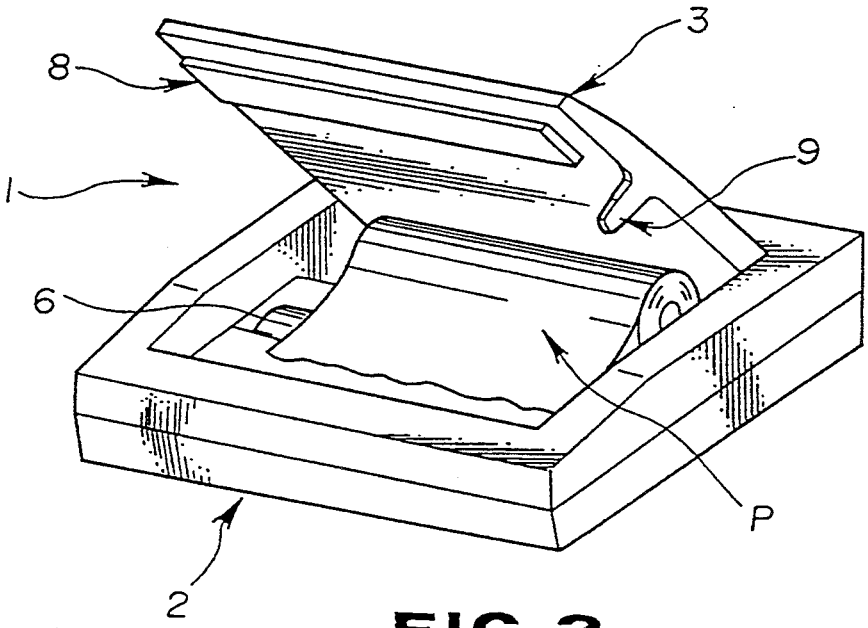
FIG. 2 is a perspective view of the electronic apparatus shown in FIG. 1.

FIGS. 1 and 2 illustrate a facsimile apparatus to which an electronic apparatus of a first embodiment of the present invention is applied.

A facsimile apparatus 1 comprises a body 2 and a cover 3. The body 2 supports the cover 3 pivotally mounted thereon so that the cover 3 can be opened and closed between a full closed position shown in solid lines of FIG. 1 and an opened position shown in phantom lines thereof.

Closing the cover 3 causes the facsimile apparatus 1 to be in a standby state or an operation wait state. That is, the facsimile apparatus 1 enables its transmission and reception operation only when the cover 3 is fully closed. The cover 3 is locked with a lock means (not shown) in the full closed position.

The body 2 is made of a nonconductive plastic box and contains a grounding member 4 made of a conductive material and mounted on the interior bottom of the body 2.

The grounding member 4 has an elastic tongue 5 as a displacement element which constitutes body side contact means and of which base portion (a left-hand end in FIG. 1) being integrally secured to the grounding member 4. As a matter of course, the elastic tongue 5 is made of the same material as the ground 4 and electrically connected with the ground 4.

Alternatively, the elastic tongue 5 may be provided separately from the grounding member 4. In this case, the elastic tongue 5 may be arranged to contact the grounding member 4 or to be electrically connected with the grounding member 4 through a conductive wire.

The body 2 contains a platen roller 6 and a printing paper discharge guide 7 both installed therein. The cover 3 is made of a conductive material such as a metal and has a printer unit 8 as an electrical component attached to the interior surface of the cover 3. On one side of the cover 3, a pressure tongue 9 as a cover side contact means is integrally formed with the cover 3 and is projecting therefrom. The pressure tongue 9 is made of the same conductive material as the cover 3.

The printer unit 8 is mounted on the cove 3 such that a portion to be grounded, e.g., a ground (not shown) or a conductive frame (not shown) holding the printer unit 8 is contacted with the cover 3 or supported on the cover 3 by means of a conductive member to electrically connect with each other. Namely, the portion to be grounded of the printer unit 8 is electrically connected to the pressure tongue 9 as the cover side contact means via the cover 3.

Alternatively, the portion of the printer unit 8 to be grounded may be electrically connected to the cover 3 or pressure tongue 9 through a conductive wire. When the cover 3 is made of a nonconductive material, a pressure tongue 9 made of a conductive material may be fastened to the cover 3 and the portion to be grounded of the printer unit 8 may be in direct contact with the pressure tongue 9, or the printer unit 8 may be electrically connected to the pressure tongue 9 through a conductive wire.

When the cover 3 is in the fully open position shown in phantom lines of FIG. 1, the elastic tongue 5 and the pressure tongue 9 are separated from each other so that the elastic tongue 5 is in its normal position shown in phantom lines of FIG. 1.

In operation, an operator mounts a printing paper P (see FIG. 2) to the apparatus body 2 by means of a paper holder (not shown), then rotates the cove 3 counterclockwise in FIG. 1 so that the cover 3 moves to its full closed position and the pressure tongue 9 on the cover 3 is first brought into contact with the elastic tongue 5 in the normal position of the body 2. Then, the operator further rotates the cover 3 counterclockwise in FIG. 1 until the cove 3 takes its full closed position, so that the pressure tongue 9 depresses the elastic tongue 5 to its lowermost position shown in solid lines of FIG. 1.

The FIG. 1 displacement of the elastic tongue 5 from its normal position shown in phantom lines to its lowermost position shown in solid lines produces a necessary restorative force (i.e., an upward force) opposite to the displacement (i.e., a downward displacement) of the elastic tongue 5. The production of the upward restorative force in the elastic tongue pressure contacts the elastic tongue 5 with the pressure tongue 9 so that both the tongues 5 and 9 are securely electrically connected with each other.

Thus, the printer unit 8 is electrically connected to the grounding member 4 by means of both the pressure tongue 9 and the elastic tongue 5, so that the grounding of the printer unit 8 is insured.

In accordance with the facsimile apparatus 1, since the printer unit 8 mounted on the cover 3 is electrically connected to the grounding member 4 attached to the body 2 not by means of a grounding wire but by means of closing the cover 3, the grounding of the printer unit 8 can be insured without the need for a troublesome assembly work of the components of the facsimile apparatus 1, so that a CPU or other electrical circuits can be prevented from a misfunction caused by a spark between the printer unit 8 and an adjacent component due to an electrostatic charge in the printer unit 8 produced by a friction of the printing paper P with the printing unit 8 during operation of the facsimile apparatus 1.

Figure 3:
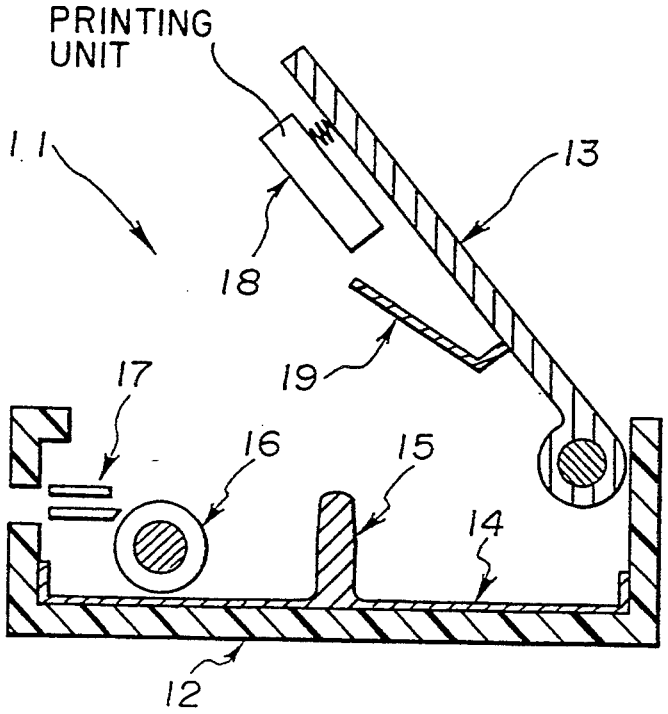
FIG. 3 is a schematic diagram of a longitudinal section of an electronic apparatus of a second embodiment of the present invention.

A facsimile apparatus 11 of the second embodiment of the present invention shown in FIG. 3 comprises a pressure tongue 15 provided in a body 12 as body side contact means, and an elastic tongue 19 as cover side contact means provided on a cover 13. The pressure tongue 15 is electrically connected to a grounding member 14. The elastic tongue 19 is electrically connected to a printer unit 18. In FIG. 3, a platen roller is indicated at 16 and a printing paper discharge guide is indicated at 17.

The facsimile apparatus 11 is different from the facsimile terminal apparatus 1 of FIGS. 1 and 2 only in that the positions of the body side contact means and the cover side contact means of the facsimile apparatus 11 are reversely provided to those of the facsimile apparatus 1. Of the facsimile apparatus 1, the full closing of the cover 13 brings the elastic tongue 19 into pressure contact with the pressure tongue 15 to insure the grounding of the printer unit 18.

Figure 4:
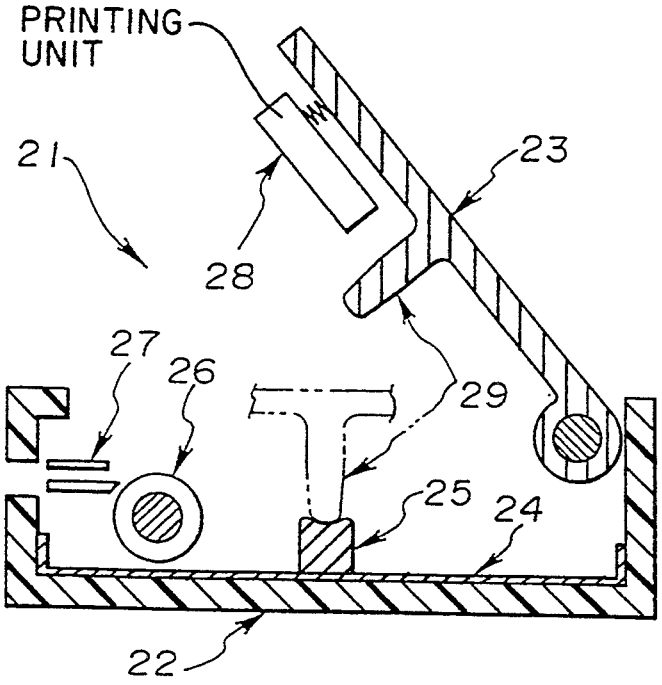
FIG. 4 is a schematic diagram of a longitudinal section of an electronic apparatus of a third embodiment of the present invention.

A facsimile apparatus 21 of the third embodiment of the present invention shown in FIG. 4 comprises projection 25 as a body side contact means provided in a body 22, and a projection 29 as cover side contact means provided on a cover 23. The pressure tongue 25 is electrically connected to a grounding member 24.

The elastic tongue 29 is electrically connected to a printer unit 28. In FIG. 3, a platen in the form of roller is indicated as 26 and a printing paper discharge guide is indicated as 27.

In operation, the closing of the cover 23 positions the cover side projection 29 in a position shown in phantom lines of FIG. 4 so that the projections 25 and 29 are in contact with each other, and the electrical connection of the printer unit 28 to the grounding member 24 through the projections 25 and 29 insures the grounding of the printer unit 28.

Figure 5:
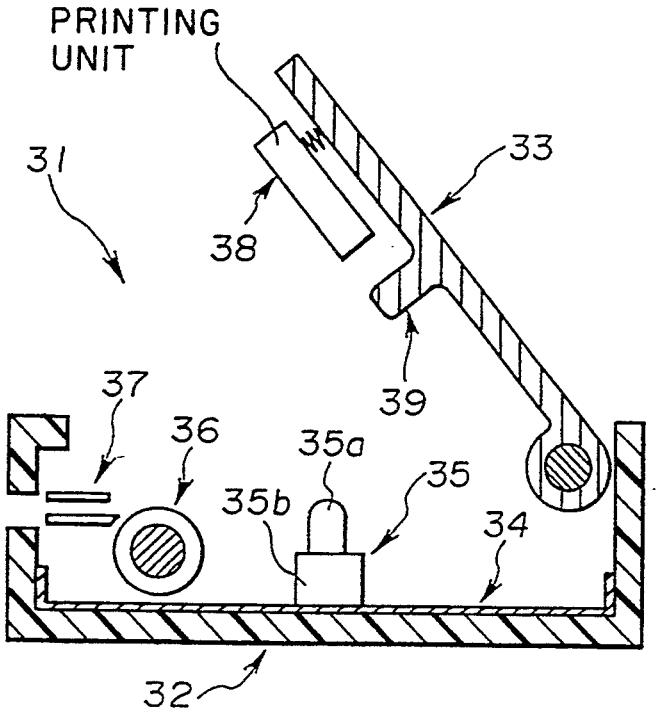
FIG. 5 is a schematic diagram of a longitudinal section of an electronic apparatus of a fourth embodiment of the present invention.

A facsimile apparatus 31 of the fourth embodiment of FIG. 5 comprises body side contact means 35 provided on the interior bottom of a body 32 and having a slide block 35*a* as a displacement element.

Figure 6:
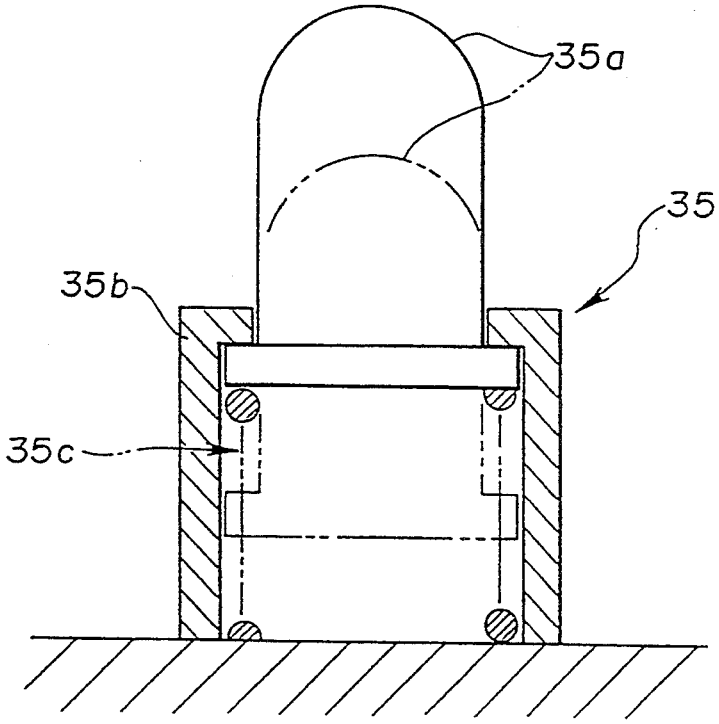
FIG. 6 is a sectional view of a main portion of an apparatus body side contact means the electronic apparatus shown in FIG. 5.

As seen in FIG. 6, the body side contact means 35 comprises the slide block 35*a*, a guide block 35*b* supporting the movable slide block 35*a* in the direction (i.e., a vertical direction in FIGS. 5 and 6) of the rotation of a cover 33, and a spring 35*c* urging the slide block 35*a* towards the cover 33 (i.e., upwards in FIGS. 5 and 6) in a direction opposite to the direction in which cover 33 is moved when moved towards a closed position.

The slide block 35*a* is made of a conductive material and electrically connected to a grounding member 34 (see FIG. 5) provided on the interior bottom of the body 32 through a conductive wire (not shown) or similar means.

As shown in FIG. 5, the interior surface of the cover 33 of the facsimile apparatus 31 has a printer unit 38 as an electrical component mounted thereon and a conductive pressure projection 39 as cover side contact means. A portion of the printer unit 38 to be grounded is electrically connected to the pressure projection 39. In FIG. 5, a platen roller is indicated as 36 and a printing paper discharge guide is indicated as 37. Both are mounted in the body 32.

When the cover 33 is in an opened position shown in FIG. 5, the slide block 35*a* is out of contact with the pressure projection 39 and is in a normal position shown in solid lines of FIG. 6.

Rotating the cover 33 counterclockwise in FIG. 5 to close, first brings the pressure projection 39 of the cover 33 into contact with the slide block 35*a* of the body 32. Further rotating the cover 33 causes the pressure projection 39 to depress the slide block 35*a* to a lowermost position shown in phantom lines of FIG. 6 while compressing the spring 35*c*. In this case, the spring 35*c* urges the slide block 35*a* upwardly to bring the slide block 35*a* into pressure contact with the pressure projection 39 to electrically connect them. Thus, the printer unit 38 is electrically connected to the grounding member 34 to insure the grounding thereof.

Figure 7:
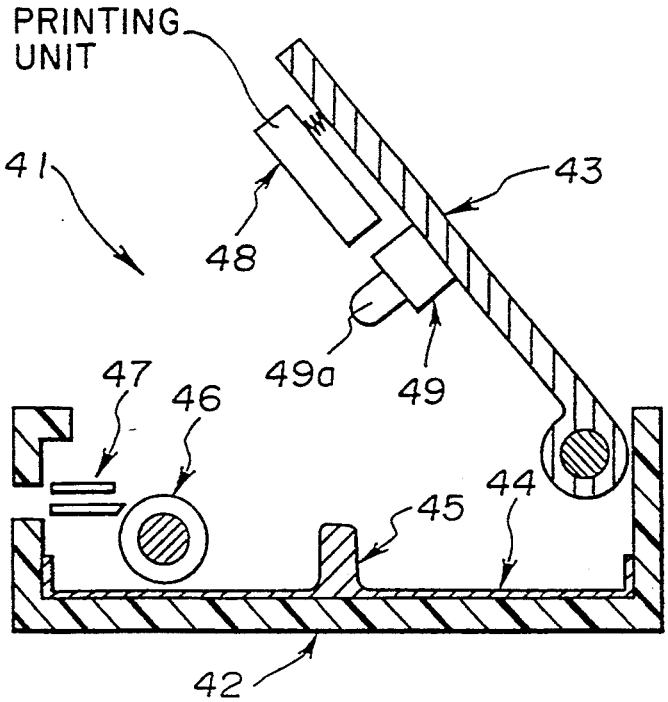
FIG. 7 is a schematic diagram of a longitudinal section of an electronic apparatus of a fifth embodiment of the present invention.

A facsimile apparatus 41 of the fifth embodiment of the present invention shown in FIG. 7 comprises a pressure projection 45 as body side contact means provided in a body 42, and cover side contact means 49 provided on a cover 43 and including a slide block 49*a*. The pressure projection 45 is electrically connected to a grounding member 44. The slide block 49*a* is electrically connected to the printer unit 48. In FIG. 7 a platen roller is indicated as 46 and a printing paper discharge guide is indicated as 47.

The facsimile apparatus 41 is different from the facsimile apparatus 31 of FIG. 5 only in that the positions of the body side contact means and the cover side contact means of the facsimile apparatus 41 are reverse to those of the facsimile apparatus 31. Similar to the facsimile apparatus 31, the closing of the cover 43 of facsimile apparatus 41 brings the pressure projection 45 into pressure contact with the slide block 49*a* to insure the grounding of the printer unit 48.

Figure 8:
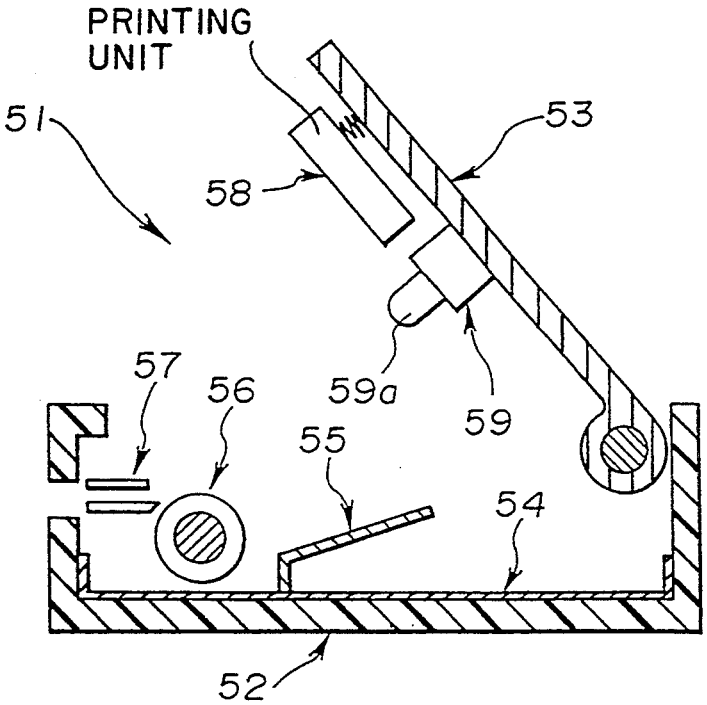
FIG. 8 is a schematic diagram of a longitudinal section of an electronic apparatus of a sixth embodiment of the present invention.

A facsimile apparatus 51 of the sixth embodiment of the present invention shown in FIG. 8 comprises an elastic tongue 55 provided on the interior bottom of a body 52 as body side contact means in the same manner as the facsimile apparatus 1 of FIG. 1, and cover side contact means 59 provided on a cover 53 and including a slide block 59*a* in the same manner as the facsimile apparatus 41 of FIG. 7. In FIG. 8, a grounding member provided in the body is indicated as 54, a platen roller is indicated as 56, a printing paper discharge guide is indicated as 57 and a printer unit is indicated as 58.

Figure 9:
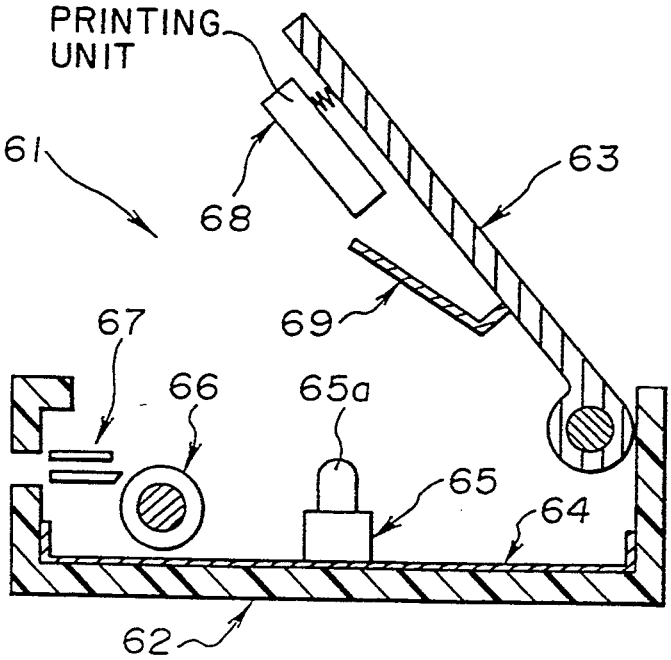
FIG. 9 is a schematic diagram of a longitudinal section of an electronic apparatus of a seventh embodiment of the present invention.

A facsimile apparatus 61 of the seventh embodiment of the present invention shown in FIG. 9 comprises body side contact means 65 provided on the interior bottom of a body 62 and including a slide block 65*a* in the same manner as the facsimile apparatus 31 of FIG. 5, and an elastic tongue 69 as cover side contact means provided on a cover 63 in the same manner as the facsimile apparatus 11 of FIG. 3. In FIG. 9, a grounding member provided in the body is indicated as 64, a platen roller is indicated as 66, a printing paper discharge guide is indicated as 67 and a printer unit is indicated as 68.

In accordance with the facsimile apparatus 51 and 61 of FIGS. 8 and 9, the full closing of the cover displaces both the body side contact means and the cover side contact means to press one contact means on the other contact means so that the printer unit is electrically well connected to the grounding member to insure its grounding.

Figure 10:
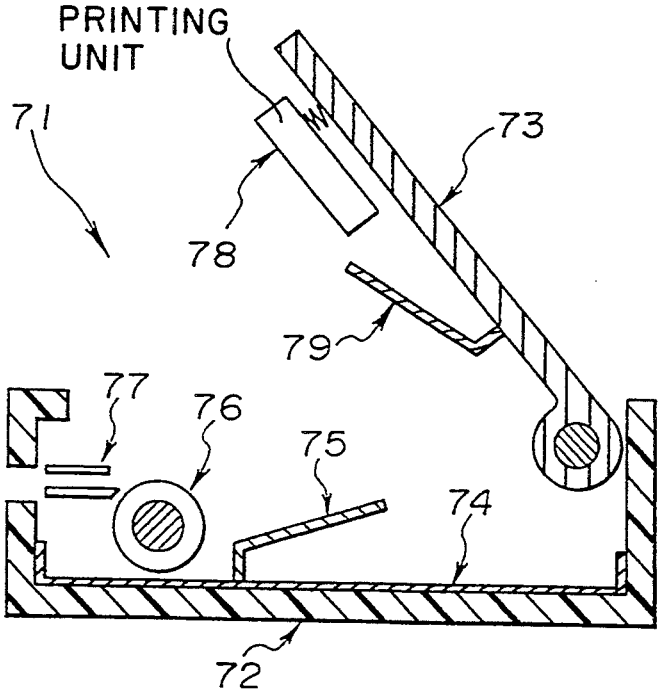
FIG. 10 is a schematic diagram of a longitudinal section of an electronic apparatus of an eighth embodiment of the present invention.

A facsimile apparatus 71 of the eighth embodiment of the present invention shown in FIG. 10 comprises an elastic tongue 75 as body side contact means provide din a body 72, and an elastic tongue 79 as cover side contact means provided on a cover 73. In FIG. 10, a grounding member provided in the body is indicated as 74, a platen roller is indicated as 76, a printing paper discharge guide is indicated as 77 and a printer unit is indicated as 78.

Figure 11:
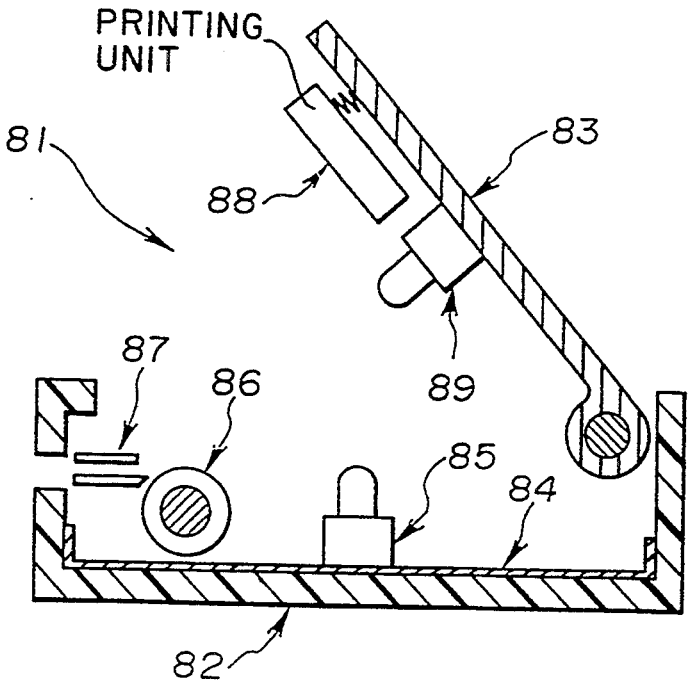
FIG. 11 is a schematic diagram of a longitudinal section of an electronic apparatus of a ninth embodiment of the present invention.

A facsimile apparatus 81 of the ninth embodiment of the present invention shown in FIG. 11 comprises body side contact means 85 provided in a body 82 and including a slide block, and cover side contact means 89 provided on a cover 83 and including a slide block. In FIG. 11, a grounding member provided in the body is indicated as 84, a platen roller is indicated as 86, a printing paper discharge guide is indicated as 87 and a printer unit is indicated as 88.

In accordance with the facsimile apparatus 71 and 81 of FIGS. 10 and 11 as with the facsimile apparatus 51 and 61 of FIGS. 8 and 9, the closing of the cover displaces both the body side contact means and the cover side contact means to press one contact means on the other contact means so that the printer unit is electrically well connected to the grounding member to insure its grounding.

Figure 12:
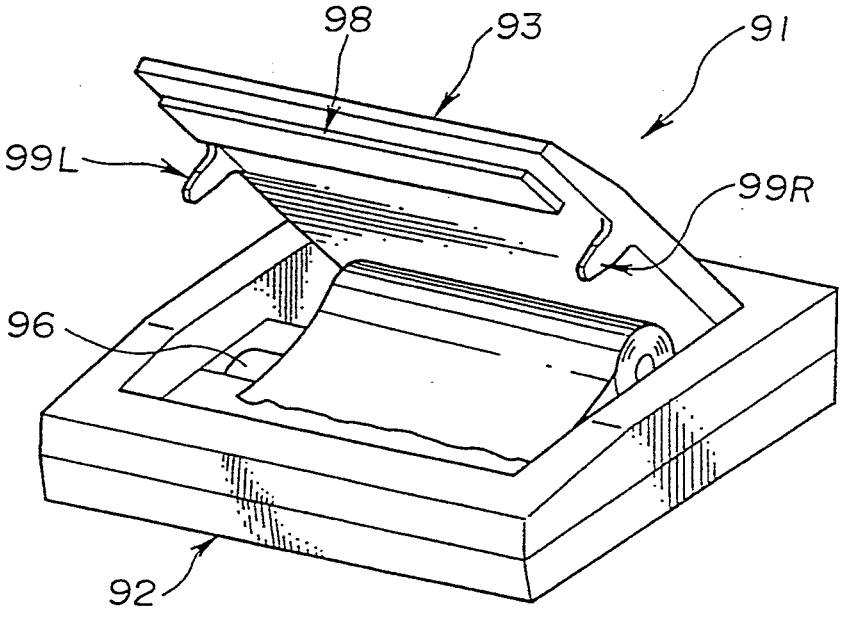
FIG. 12 is a perspective view of an electronic apparatus of a tenth embodiment of the present invention.

A facsimile apparatus 91 of the tenth embodiment of the present invention shown in FIG. 12 comprises pressure tongues 99L and 99R as cover side contact means projecting from the left-hand and right-hand side edges of a cover 93, and elastic tongues (not shown) having the same arrangement as those of the FIG. 1 facsimile apparatus 1 and provided in a body 92. The elastic tongues constitute body side contact means so that the closing of the cover 93 brings the elastic tongues into pressure contact with the pressure tongues 99L and 99R.

In accordance with this arrangement, a release of a lock means (not shown) having locked the cover 93 in its fully closed position enables the forces continuously present restorative of the respective elastic tongues or displacement elements (see the elastic tongue 5 of FIG. 1) of the body side contact means to move the pressure tongues 99L and 99R upwards, so that the cover 93 is pushed open and leaps slightly upwards from its fully closed position. Thus, the operator can easily hold the cover 93 and rotate it to an opened position of the cover 93 (see the opened position of the cover 3 shown in the phantom lines of FIG. 1).

In this case, the release of the lock means enables the forces of the elastic tongues to simultaneously move upwards the pressure tongues 99L and 99R, so that a pivot for the cover 93 (see the pivot 3*a* of FIG. 1) receives no excessive force. Thus, the cover 93 smoothly and securely operates to insure an excellent operability.

Of course, arrangements and combinations of the body side contact means and the cover side contact means of the facsimile apparatus 91 may comprise the arrangements and combinations of FIG. 3–11.

Figure 13:
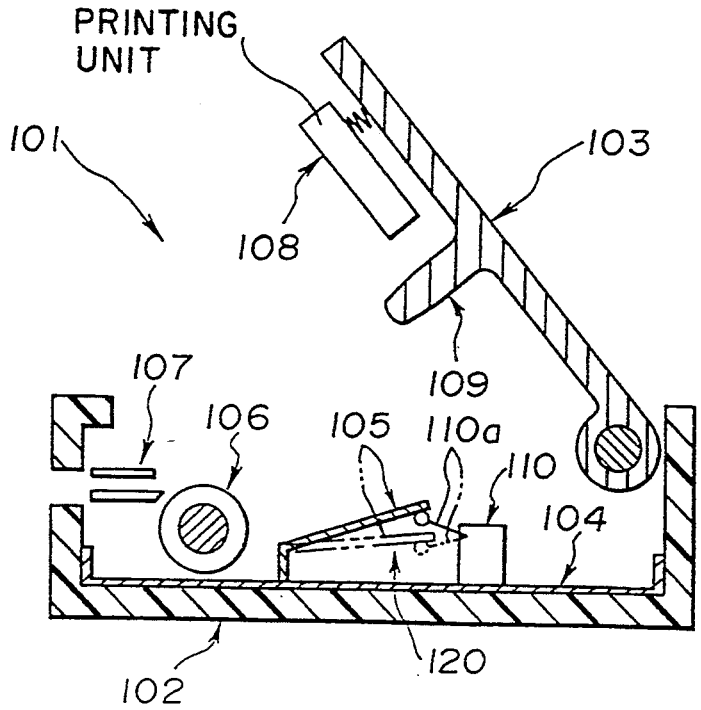
FIG. 13 is a schematic diagram of a longitudinal section of an electronic apparatus of an eleventh embodiment of the present invention.

A facsimile apparatus 101 of the eleventh embodiment of the present invention shown in FIG. 13 comprises an elastic tongue 105 as body side contact means provided on the interior bottom of a body 102, and a pressure tongue 109 as cover side contact means provided on a cover 103 the facsimile apparatus 1 of FIG. 1, and further comprises a switch (e.g., microswitch) 110 provided on the interior bottom of the body 102 so that an actuator unit 110*a* is in an operational range of the elastic tongue 105. The elastic tongue 105 and the switch 110 together constitute a switch assembly or means 120 for sensing the full closed position of the cover 103 based on the actual mechanical movement of the displacement element (elastic tongue 105). In FIG. 13, a grounding member provided in the body is indicated as 104, a platen roller is indicated as 106, a printing paper discharge guide is indicated as 107 and a printer unit is indicated as 108.

Figure 14:
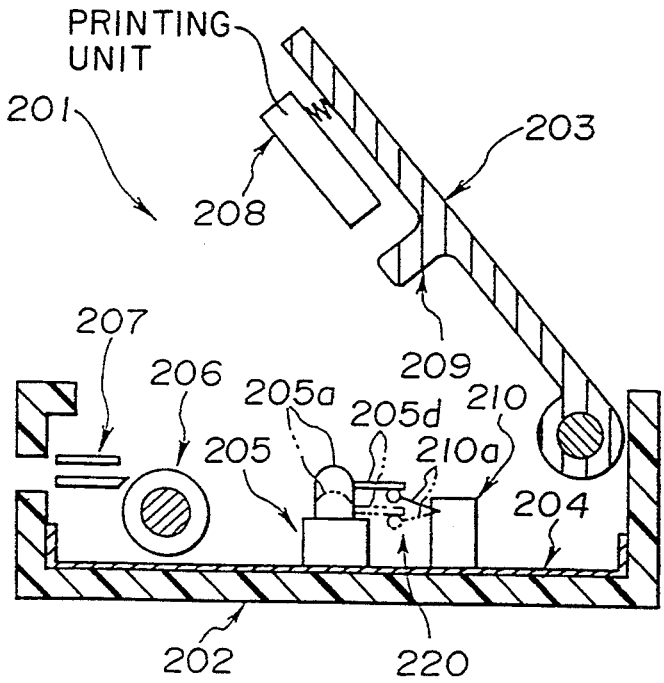
FIG. 14 is a schematic diagram of a longitudinal section of an electronic apparatus of a twelfth embodiment of the present invention.

A facsimile apparatus 201 of the twelfth embodiment of the present invention shown in FIG. 14 comprises body side contact means 205 provided on the interior bottom of a body 202 and including a slide block 205*a*, and a pressure projection 209 as cover side contact means provided on a cover 203, in the same manner as the facsimile apparatus 31 of FIG. 5 and further comprises a switch 210 (microswitch) provided on the interior bottom of the body 202 so that an actuator unit 210*a* is in an operational range of the slide block 205*a*, i.e., a range of movement of an actuation rod 205*d* projecting laterally from the slide block 205*a*. The slide block 205*a* and the switch 210 together constitute switch means 220. In FIG. 14, a grounding member provide din the body is indicated as 204, a platen roller is indicated as 206, a printing paper discharge guide is indicated as 206 and a printer unit is indicated as 208.

In accordance with the facsimile apparatus 101 of FIG. 13, the closing of the cover 103 brings the pressure tongue 109 into pressure contact with the elastic tongue 105 to insure the grounding of the printer unit 108 and simultaneously causes the elastic tongue 105 displaced to its lowermost position shown in phantom lines of FIG. 13 to depress the actuator unit 110*a* of the switch 110 to an ON position shown in phantom lines. Thus, the facsimile apparatus 101 senses the full closed position of the cover 103 on the basis of an ON signal from the switch 110.

In accordance with the facsimile apparatus 201 of FIG. 14, the closing of the cover 203 brings the pressure projection 209 into pressure contact with the slide block 205*a* to insure the grounding of the printer unit 208 and simultaneously causes the slide block 205*a* (actuation lever 205*d*) to be displaced to its lowermost position shown in phantom lines of FIG. 14 to depress the actuator unit 210*a* of the switch 210 to an ON position shown in phantom lines. Thus, the facsimile apparatus 201 senses the full closed position of the cover 203.

The ON signal from the switch lights an indication lamp (now shown) to indicate the full closed position of the cover to the operator. A control unit (not shown) concurrently receives the ON signal as an interlocking signal enabling transmission and reception of the facsimile apparatus and prevents a misoperation by the operator and a misfunction of the facsimile apparatus.

In accordance with the facsimile apparatus 101 and 201 of FIGS. 13 and 14, since the body side contact means (elastic tongue 105 and slide block 205*a*) which are displaced by a rotational movement of the cover are arranged to actuate the actuator unit of the switch, the number of components of the facsimile apparatus 101 and 201 can be decreased compared to that of a prior-art facsimile apparatus which requires an exclusive operational component for actuating the actuator unit.

Figure 15:
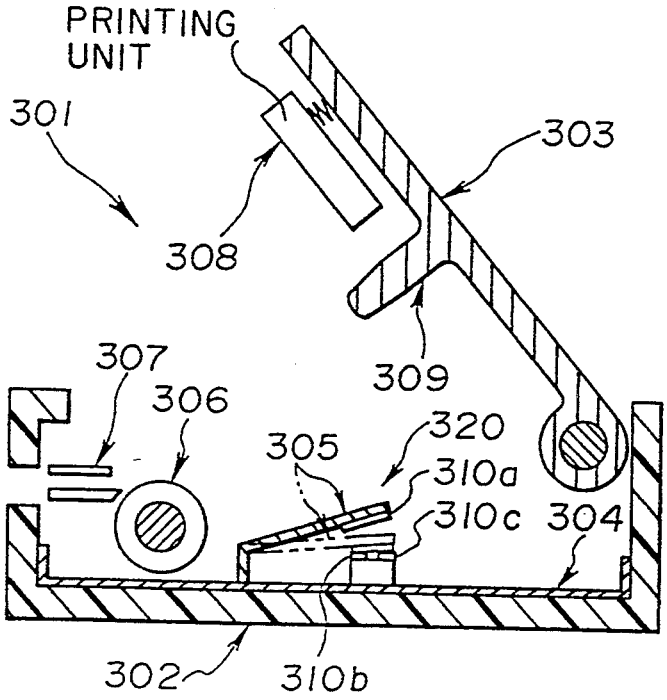
FIG. 15 is a schematic diagram of a longitudinal section of an electronic apparatus of a thirteenth embodiment of the present invention.

A facsimile apparatus 301 of the thirteenth embodiment of the present invention shown in FIG. 15 comprises an elastic tongue 305 as body side contact means provided on the interior bottom of a body 302, a pressure tongue 309 as cover side contact means provided on a cover 303, a movable contact 310*a* fastened to the underside of the elastic tongue 305 and fixed contacts 310*b* and 310*c* provide din the body 302. The elastic tongue 305, the movable contact 310*a* and the fixed contacts 310*b* and 310*c* together constitute switch means 320. In FIG. 15, a grounding member provided in the body is indicated at as 304, a platen roller is indicated as 306, a printing paper discharge guide is indicated as 307 and a printer unit is indicated as 308.

Figure 16:
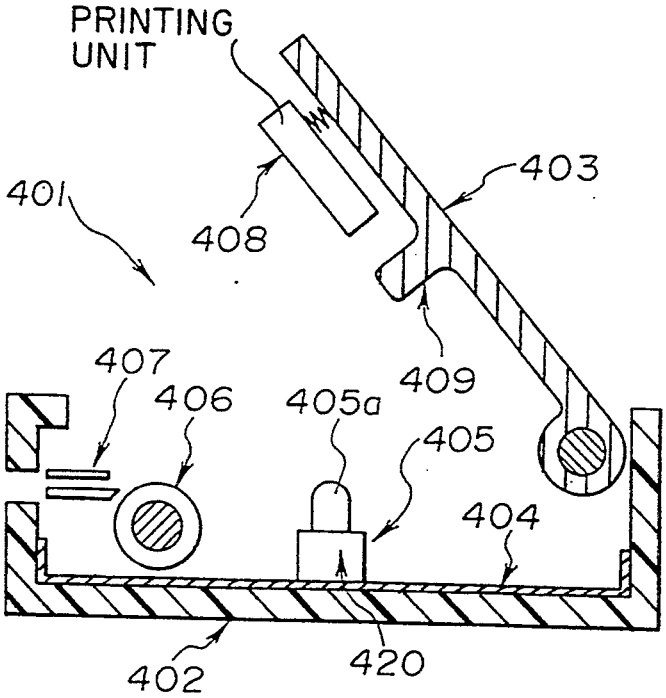
FIG. 16 is a schematic diagram of a longitudinal section of an electronic apparatus of a fourteenth embodiment of the present invention.
Figure 17:
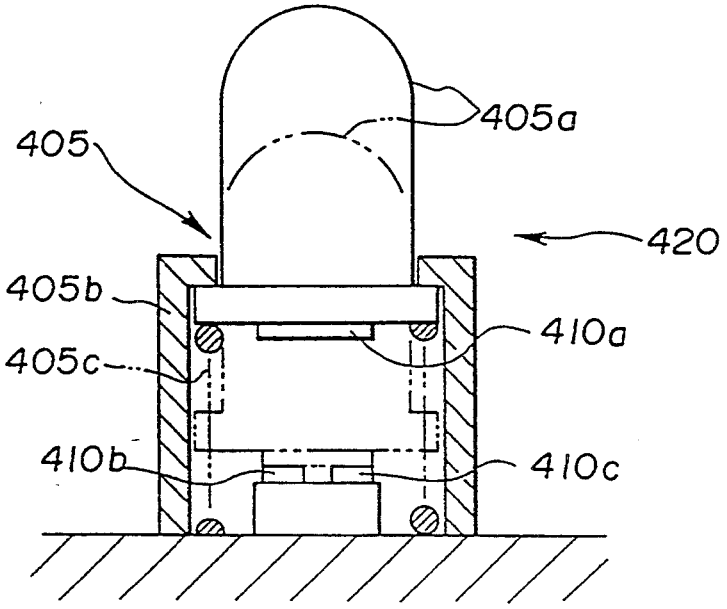
FIG. 17 is a sectional view of main portions of an apparatus body side contact means and a switch means of the FIG. 16 electronic apparatus.
Figure 18:
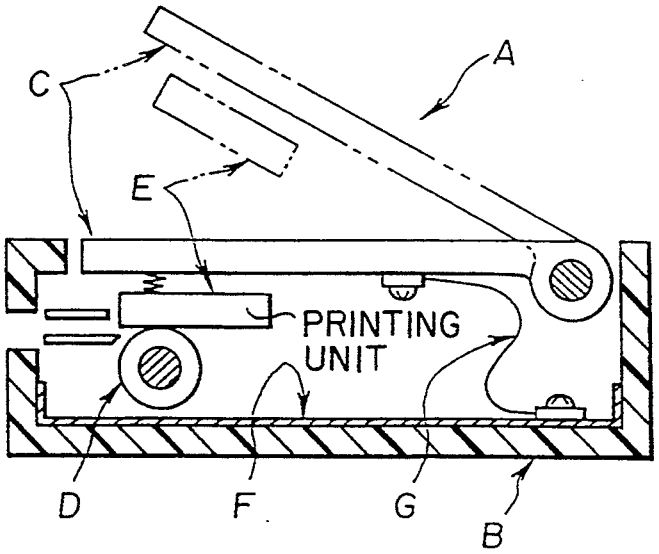
FIG.18 (PRIOR ART)
FIG. 18 is a schematic diagram of a longitudinal section of a prior-art electronic apparatus.

A facsimile apparatus 401 of the seventh embodiment of the present invention shown in FIG. 16 comprises body side contact means 405 provided on the interior bottom of a body 402 and including a slide block 405*a*, a pressure projection 409 as cover side contact means provided on a cover 403, a movable contact 410*a* attached to the underside of the slide block 405*a* as shown in FIG. 17, and fixed contacts 410*b* and 410*c* provided in the apparatus body 402. The slide block 405*a*, the movable contact 410*a* and the fixed contacts 410*b* and 410*c* together constitute switch means 420. In FIG. 16, a grounding member provide din the body is indicated as 404, a platen roller is indicated as 406, a printing paper discharge guide is indicated as 406 and a printer unit is indicated as 408.

In accordance with the FIG. 15 facsimile apparatus 301, the full closing of the cover 303 brings the pressure tongue 303 into pressure contact with the elastic tongue 305 to insure the grounding of the printer unit 308 and simultaneously brings the movable contact 310*a* into contact with the fixed contacts 310*b* and 310*c* by means of the elastic tongue 305 displaced to its lowermost position shown in phantom lines of FIG. 15 to turn the switch means 320 on. Thus, the facsimile apparatus 301 senses the full closed position of the cover 303.

In accordance with the FIG. 16 facsimile apparatus 401, the full closing of the cover 403 brings the pressure projection 409 into pressure contact with the slide block 405*a* to insure the grounding of the printer unit 408 and simultaneously brings the movable contact 410*a* into contact with the fixed contacts 410*b* and 410*c* by means of the slide block 405*a* in the position shown in phantom lines of FIG. 17 to turn the switch means 420 on. Thus, the facsimile apparatus 401 senses the full closed position of the cover 403.

Since the facsimile apparatus 301 and 401 shown in FIGS. 15 and 16 utilize the body side contact means (elastic tongue 305 and slide block 405*a*) which are displaced together with the movement of the cover as constituent components of the switch means having the movable contact and the fixed contact, the number of components of the facsimile apparatus 301 and 401 can be decreased compared to that of the prior-art facsimile apparatus which requires an exclusive switch and the overall size of the FIGS. 15 and 16 facsimile apparatus can be minimized since a space for the separate switch is not required.

The above embodiments have described applications of the present invention to the facsimile apparatus. However, it should be understood that the present invention is also applicable to various electronic apparatus such as copying machines and the like without departing from the scope and spirit of the invention.

What is claimed is:

1. An electronic apparatus including a body provided with a grounding member and a cover having an electrical component and pivotally supported on said body to be opened and closed, said electronic apparatus being controlled to be in a standby state when said cover is fully closed, comprising:

conductive body side contact means provided on said body and electrically connected to said grounding member of said body; and conductive cover side contact means provided on said cover and electrically connected to a portion of the electrical component to be grounded, said cover side contact means being separated from said body side contact means so as to be electrically disconnected from said body side contact means when said cover is in an open position and being in contact with said body side contact means so as to electrically connect said electric component with said grounding member when said cover is in a fully closed position, wherein at least one of said body side contact means and said cover side contact means has a displacement element which is increasingly displaced as said cover is moved towards said closed position, said displacement element being urged by a restorative force against the other one of said contact means to make a pressure contact with the other one of said contact means, and wherein said restorative force is continually present while said cover is closed such that said restorative force pushes said cover open when said cover is released.

2. The electronic apparatus of claim 1, wherein said displacement element comprises an elastic tongue having a fixed end.

3. The electronic apparatus of claim 1, wherein said displacement element comprises a slide block movable in the direction of rotation of the cover and urged by a spring in a direction opposite to the direction in which said cover is moved when moved towards said closed position.

4. The electronic apparatus of claim 1, wherein said cover side contact means is provided on a left-hand side edge and a right-hand side edge of said cover, respectively.

5. An electronic apparatus including a body provided with a grounding member and a cover having an electrical component and pivotally supported on said body to be opened and closed, said electronic apparatus being controlled to be in a standby state when said cover is fully closed, comprising:

conductive body side contact means provided on said body and electrically connected to said grounding member of said body;

conductive cover side contact means provided on said cover and electrically connected to a portion of said electrical component to be grounded, said cover side contact means being separated from said body side contact means so as to be electrically disconnected from said body side contact means when said cover is in an open position and being in contact with said body side contact means so as to electrically connect said electric component with said grounding member when said cover is in a fully closed position;

a displacement element provided on at least one of said body side contact means and said cover side contact means, said displacement element being urged by a restorative force against the other one of said contact means to make a pressure contact with the other one of said contact means; and switch means for detecting opened and closed statuses of said cover on the basis of an actual mechanical movement of said displacement element.

6. An electronic apparatus including a body provided with a grounding member and a cover having an electrical component and pivotally supported on said body to be opened and closed, said electronic apparatus being controlled to be in a standby state when said cover is fully closed, comprising:

conductive body side contact means provided on said body and electrically connected to said grounding member of said body;

conductive cover side contact means provided on said cover and electrically connected to a portion of said electrical component to be grounded, said cover side contact means being separated from said body side contact means so as to be electrically disconnected from said body side contact means when said cover is in an open position and being in contact with said body side contact means so as to electrically connect said electric component with said grounding member when said cover is in a fully closed position;

a displacement element provided on at least one of said body said contact means and said cover side contact means, said displacement element being urged by a restorative force against the other one of said contact means to make a pressure contact with the other one of said contact means; and switch means for detecting opened and closed statuses of said cover on the basis of a displacement movement of said displacement element, wherein said switch means includes at least one of said body side contact means and said cover side contact means and a switch unit having an actuator being disposed within an operational range of said displacement element on said one of the contact means.

7. An electronic apparatus including a body provided with a grounding member and a cover having an electrical component and pivotally supported on said body to be opened and closed, said electronic apparatus being controlled to be in a standby state when said cover is fully closed, comprising:

conductive body side contact means provided on said body and electrically connected to said grounding member of said body;

conductive cover side contact means provided on said cover and electrically connected to a portion of said electrical component to be grounded, said cover side contact means being separated from said body side contact means so as to be electrically disconnected from said body side contact means when said cover is in an open position and being in contact with said body side contact means so as to electrically connect said electric component with said grounding member when said cover is in a fully closed position;

a displacement element provided on at least one of said body side contact means and said cover side contact means, said displacement element being urged by a restorative force against the other one of said contact means to make a pressure contact with the other one of said contact means; and switch means for detecting opened and closed statuses of said cover on the basis of a displacement movement of said displacement element, wherein said switch means includes at least one of said body side contact means and said cover side contact means, a movable contact mounted to said displacement element, and a fixed contact disposed at a position where said fixed contact is brought into contact with said movable contact when said cover is fully closed.

8. A method for grounding an electronic apparatus disposed on a cover pivotably supported on a body so as to be opened and closed, wherein the electronic apparatus is not grounded when the cover is in an open position, the method comprising the steps of:

rotating the cover to a closed position;

contacting conductive body side contact means provided on said body and electrically connected to a grounding member of said body with conductive cover side contact means provided on said cover and electrically connected to a portion of said electrical apparatus to be grounded;

increasingly displacing a displacement element of at least one of said body side contact means and said cover side contact means as said cover is rotated until the cover is in a closed position;

producing restorative force to urge said displacement element against the other of said two contact means to make a pressure contact with the other one of said contact means, and wherein said restorative force is continually present while said cover is closed such that the restorative force pushes said cover open when said cover is released; and pressure contacting said cover side contact means with said body side contact means so as to electrically connect said electrical apparatus to the grounding member of said body.

* * * * *